US008323059B1

(12) United States Patent
Song et al.

(10) Patent No.: US 8,323,059 B1
(45) Date of Patent: Dec. 4, 2012

(54) ELECTRICAL CONNECTOR ASSEMBLY

(75) Inventors: Yong-Jun Song, Shenzhen (CN); Yong-Zhao Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/207,468

(22) Filed: Aug. 11, 2011

(30) Foreign Application Priority Data

Jul. 19, 2011 (CN) ..... 2011 1 0202189

(51) Int. Cl.
*H01R 13/64* (2006.01)

(52) U.S. Cl. ..... 439/680

(58) Field of Classification Search ..... 439/680, 439/677, 153, 326, 356, 352, 681, 248, 304, 439/308, 309, 324, 345, 346, 374
See application file for complete search history.

(56) References Cited

U.S. PATENT DOCUMENTS 4,332,432 A * 6/1982 Colleran ..... 439/347
4,986,769 A * 1/1991 Adams et al. ..... 439/681
7,261,579 B2 * 8/2007 Ku et al. ..... 439/289
7,533,179 B2 * 5/2009 Tarquini et al. ..... 709/228
2003/0109180 A1 * 6/2003 Mueller ..... 439/680
2003/0199202 A1 * 10/2003 Ju ..... 439/680
2004/0072432 A1 * 4/2004 Yun et al. ..... 438/689

* cited by examiner

*Primary Examiner* — Edwin A. Leon
*Assistant Examiner* — Harshad Patel
(74) *Attorney, Agent, or Firm* — Altis Law Group, Inc.

(57) ABSTRACT

An electrical connector assembly includes a male connector and a female connector for connectable to the male connector. The male connector includes a male insulating housing and a number of first terminals assembled on the male insulating housing. An anti-mistake insertion bulge extends from the top surface of the male insulating housing. The female connector includes a female insulating housing and a number of second terminals assembled to the female insulating housing for connecting with the first terminals. An anti-mistake insertion gap is defined in the top surface of the female insulating housing. Two cutouts are defined in two opposite sidewalls bounding the anti-mistake insertion gap to hold the anti-mistake insertion bulge.

4 Claims, 3 Drawing Sheets

ELECTRICAL CONNECTOR ASSEMBLY

BACKGROUND

1. Technical Field

The present disclosure relates to an electrical connector assembly.

2. Description of Related Art

An electrical connector assembly generally includes a male connector and a female connector connectable to the male connector. For the male connector with a rectangular connection portion and the female connector defining a rectangular recess to hold the connection portion, a great force is needed to insert the male connector into the female connector or disassemble the male connector from the female connector. The amount of force used by a person cannot be accurately controlled and may easily be too great and damage the connectors.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
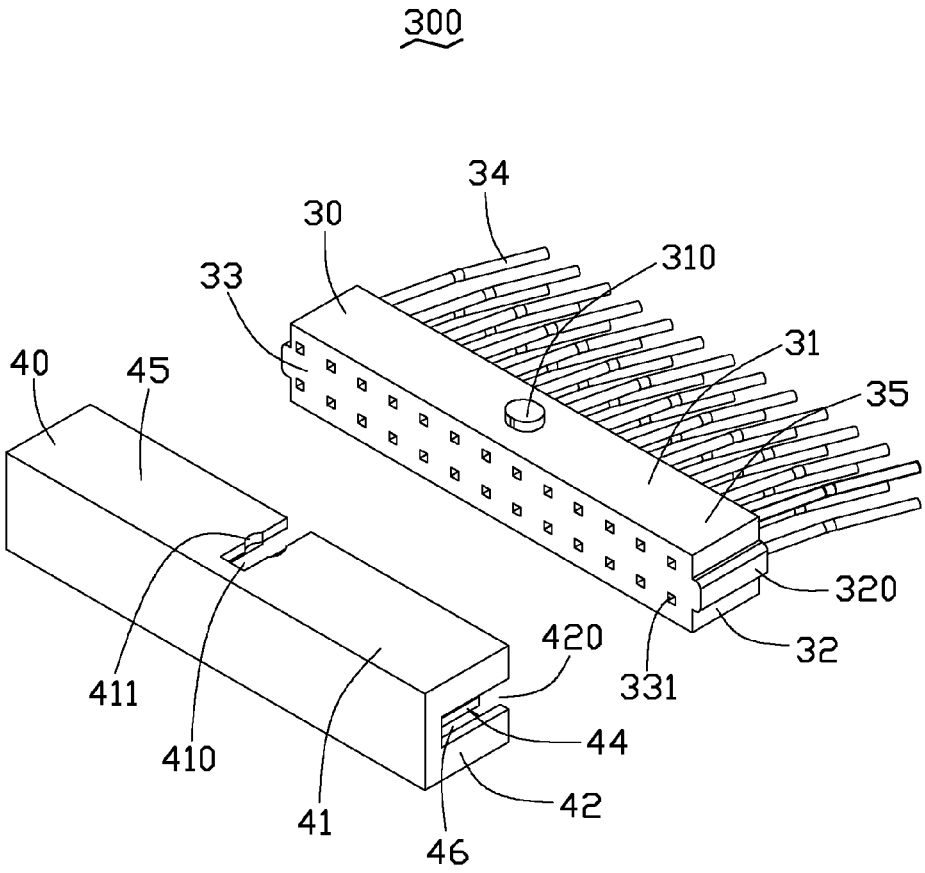
FIG. 1 is an exploded, isometric view of an exemplary embodiment of an electrical connector assembly, wherein the electrical connector assembly includes a male connector.
Figure 3:
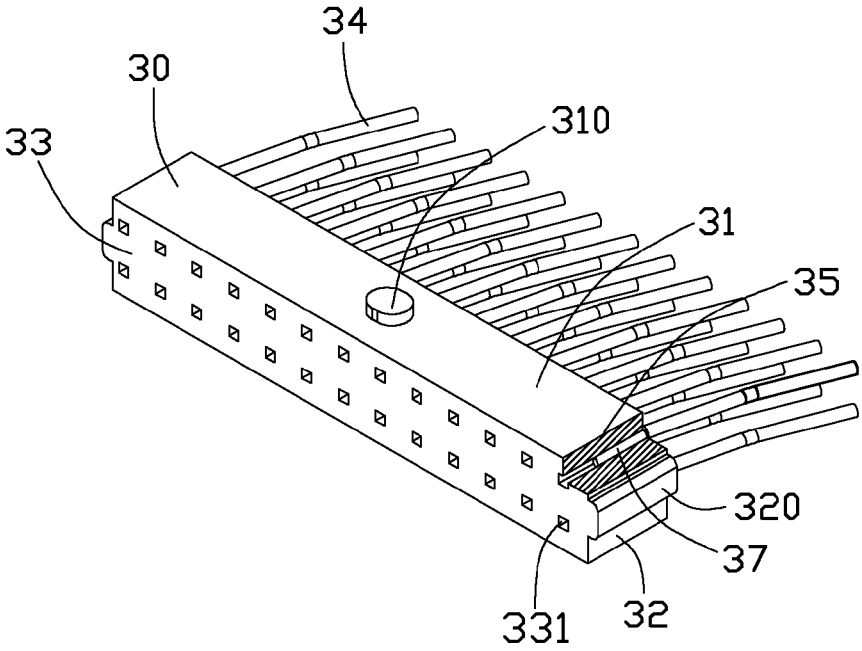
FIG. 3 is a cutaway view of the male connector of FIG. 1.

Referring to FIGS. 1 and 3, an exemplary embodiment of an electrical connector assembly 300 includes a male connector 30 and a female connector 40 connectable with the male connector 30.

The male connector 30 includes a rectangular insulating housing 35 and a plurality of cables 34. The insulating housing 35 defines a plurality of slots 331 extending through a front surface 33 to a back surface opposite to the front surface 33. A plurality of terminals 37 is embedded in the slots 331 and connected to the cables 34. An anti-mistake insertion bulge 310 protrudes from a top of the insulating housing 35. The bulge 310 is substantially ellipsoid. A long axis of the bulge 310 is parallel to the front surface 33. Two blocks 320 protrude from left and right end surfaces 32 of the insulating housing 35, respectively. In another embodiment, the bulge 310 can be circular.

The female connector 40 includes a rectangular insulating housing 45. The insulating housing 45 defines a recess 46 in a rear surface of the insulating housing 45. A plurality of terminals 44 is assembled in the recess 46. An anti-mistake insertion gap 410 communicating with the recess 46 is defined in a top 41 of the insulating housing 45. Two opposite sidewalls bounding the gap 410 define two arc-shaped cutouts 411, respectively. The length of the long axis of the bulge 310 is greater than the width of the gap 410, but equal to or slightly less than the distance between walls bounding the cutouts 411. Two grooves 420 are defined in left and right end surfaces 42 of the insulating housing 45, respectively. The grooves 420 extend through the back surface of the insulating housing 45.

Figure 2:
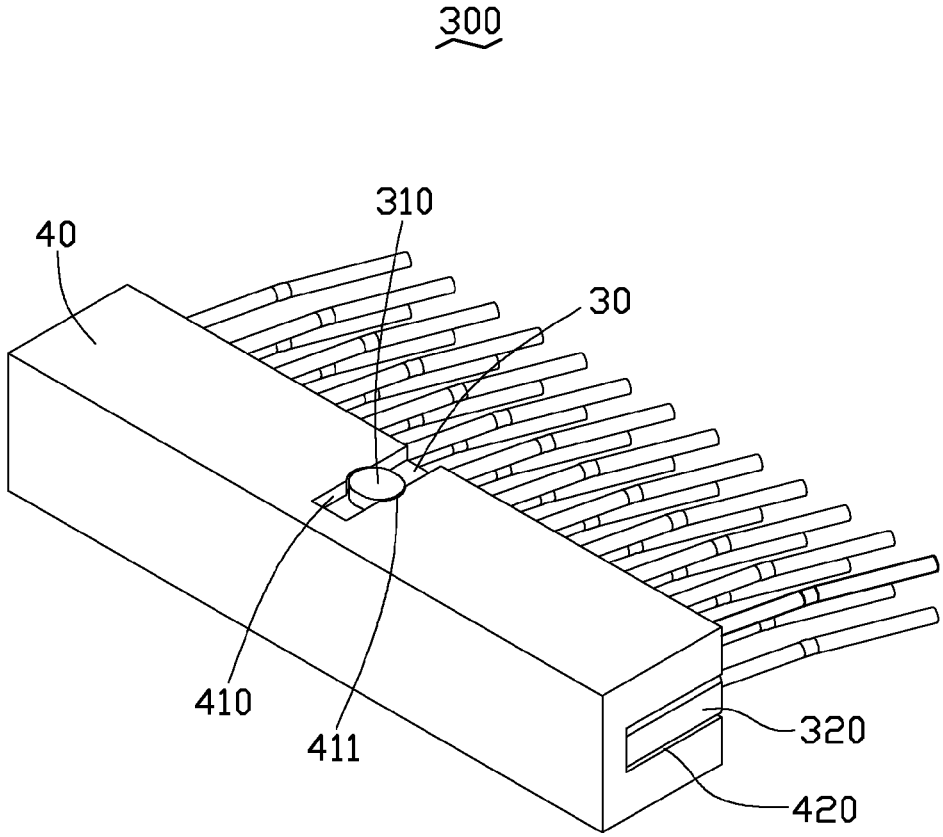
FIG. 2 is an assembled, isometric view of FIG. 1.

Referring to FIG. 2, in assembly, the insulating housing 35 of the male connector 30 is inserted into the recess 46 of the female connector 40, and the blocks 320 enter the corresponding grooves 420. The bulge 310 enters the gap 410 to slightly deform the sidewalls bounding the gap 410 away from each other. After the bulge 310 enters the cutouts 411, the sidewalls bounding the gap 410 are restored, thereby holding the bulge 310 in the cutouts 411, and the long axis of the bulge 310 is substantially perpendicular to the extending direction of the gap 410. The male connector 30 is then fastened to the female connector 40. The terminals 37 are connected to the terminals 44. In disassembly, the male connector 30 is moved away from the recess 46, and the bulge 310 is operated to disengage from the cutouts 411 and deform the sidewalls bounding the gap 410. The blocks 320 disengage from the corresponding grooves 420.

It is to be understood, however, that even though numerous characteristics and advantages of the present disclosure have been set forth in the foregoing description, together with details of the structure and function of the disclosure, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. An electrical connector assembly, comprising:

a male connector comprising a male insulating housing and a plurality of first terminals assembled to the male insulating housing, an anti-mistake insertion bulge extending up from a top surface of the male insulating housing; and a female connector comprising a female insulating housing which defines a recess for accommodating the male insulating housing, and a plurality of second terminals, to connect to the first terminals, assembled in the recess, a top surface of the female insulating housing defining an anti-mistake insertion gap communicating with the recess;

wherein two opposite sidewalls bounding the gap define two cutouts, respectively to hold the anti-mistake insertion bulge therein; the cutouts are substantially arc-shaped, the anti-mistake insertion bulge is substantially ellipse-shaped, and a long axis of the anti-mistake insertion bulge is substantially perpendicular to an extending direction of the anti-mistake insertion gap when the anti-mistake insertion bulge is held by the two cutouts.

2. The electrical connector assembly of claim 1, wherein a length of the long axis of the anti-mistake insertion bulge is greater than a width of the anti-mistake insertion gap.

3. The electrical connector assembly of claim 2, wherein the length of the long axis of the anti-mistake insertion bulge is equal to or slightly less than a distance between the sidewalls bounding the cutouts.

4. The electrical connector assembly of claim 1, wherein two blocks extend from opposite end surfaces of the male insulating housing, and two grooves are defined in opposite end surfaces of the female insulating housing to respectively hold the two blocks.

* * * * *